US007380493B2

(12) United States Patent
Park et al.

(10) Patent No.: US 7,380,493 B2
(45) Date of Patent: Jun. 3, 2008

(54) COMPRESSOR

(75) Inventors: Dong Woo Park, Busan-si (KR); Min Kyu Jung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 807 days.

(21) Appl. No.: 10/814,506

(22) Filed: Apr. 1, 2004

(65) Prior Publication Data

US 2004/0253131 A1 Dec. 16, 2004

(30) Foreign Application Priority Data

Jun. 13, 2003 (KR) ..... 10-2003-0038430

(51) Int. Cl.
*F16J 1/04* (2006.01)

(52) U.S. Cl. ..... 92/239; 92/233

(58) Field of Classification Search ..... 92/208, 92/233, 239; 417/497, 569, 571
See application file for complete search history.

(56) References Cited

U.S. PATENT DOCUMENTS 2,025,240 A * 12/1935 Higham ..... 417/571
2,863,707 A * 12/1958 Lengnick ..... 92/208
5,149,254 A * 9/1992 Riffe ..... 417/569
5,816,783 A * 10/1998 Oshima et al. ..... 417/415
6,152,017 A * 11/2000 Harrer et al. ..... 92/208
6,540,492 B2 * 4/2003 Kaido et al. ..... 417/571
6,623,258 B1 * 9/2003 Iversen et al. ..... 417/559
6,928,921 B2 * 8/2005 Brabek ..... 92/208

FOREIGN PATENT DOCUMENTS

WO WO 0202944 A1 * 1/2002

* cited by examiner

*Primary Examiner*—Michael Leslie
(74) *Attorney, Agent, or Firm*—Ked & Associates, LLP

(57) ABSTRACT

A reciprocating compressor is provided that includes a compression chamber inside of a cylinder and a piston inserted therein. The piston includes a head, a skirt extended from a lower end of the head so as to be spaced away from an inside wall of the cylinder, and guide surfaces extended from an outside surface of the skirt. Since the skirt is not in contact with the cylinder, a friction loss between the piston and the cylinder is reduced, and the guide surfaces assist the piston to make stable reciprocation. The head has a projection so as to be inserted into a discharge hole when the piston is at a top dead center. According to this, a dead volume formed when the piston is at the top dead center is reduced, thereby improving an efficiency of the compressor.

20 Claims, 5 Drawing Sheets

COMPRESSOR

This application claims the benefit of the Korean Application No. P2003-38430 filed on Jun. 13, 2003, which is hereby incorporated by reference.

BACKGROUND OF THE INVENTION

1. Field of the Invention

The present invention relates to compressors, and more particularly, to a reciprocating compressor having a piston for reciprocating in a cylinder to compress a working fluid.

2. Background of the Related Art

The compressor boosts a pressure of the working fluid by receiving a power from an electric motor or a turbine, and applying a compressive work to air, refrigerant, or other special gas. The compressor is widely used starting from home appliances, to plant industries in the fields of air conditioners, or refrigerators.

Depending on methods of compression, there are positive displacement compressors, and dynamic compressors, or turbo compressors. In the positive displacement compressors for boosting a pressure by reduction of a volume, there are reciprocating compressors, and rotary compressors.

The reciprocating compressor, compressing the working fluid by means of a piston reciprocating inside of a cylinder, is advantageous in that a high compression efficiency can be provided by using comparatively simple mechanical components.

The rotary compressor, compressing the working fluid by means of a roller revolved inside of a cylinder with an eccentricity, can provide a high compression efficiency at a speed lower than the reciprocating compressor.

FIG. 1 illustrates a typical example of the reciprocating compressor, referring to which the reciprocating compressor will be described in more detail.

Referring to FIG. 1, two pieces of cases 1 assembled together form an enclosed space, in which a frame 2 is provided. The frame 2 is supported on an inside of the case 1 with springs 4.

There is a crankshaft 6 mounted passed through a central part of the frame 2. For this, there is a boss 3 in the central part of the frame 2 for stable support of the crankshaft 6.

The crankshaft 6 mounted thus, is rotated by the motor 5 having a stator 5*a* and a rotor 5*b*. The stator 5*a* is fixed to the frame 2, and the rotor 5*b* is fixed to the crankshaft 6. Since the rotor 5*b* positions inside of the stator 5*a*, the crankshaft 6 rotates together with the rotor 5*b* when power is provided to the motor 5.

Referring to FIG. 1, there is an eccentric pin 6*a* on top of the crankshaft 6 at an eccentric position from a rotation center of the crankshaft 6. There is a balance weight 6*b* on top of the crankshaft at an opposite side of the eccentric pin 6*a*. The balance weight 6*b* prevents the crankshaft 6 from shaking due to weight of the eccentric pin 6*a* during rotation of the crankshaft 6.

In the meantime, there is lubricating oil held on a bottom of the case 1, and the crankshaft 6 has oil passages 6*c* inside of the crankshaft 6. Accordingly, when the crankshaft 6 rotates, lubricating oil moves following the oil passage 6*c*, and sprayed from the top of the crankshaft 6. According to this, the lubricating oil is supplied to all mechanically operative components in the case 1.

There are a cylinder 10 having a compression chamber 11 therein in one side part of top of the frame 2, and a piston 15 in the compression chamber 11 to reciprocate in the cylinder 10 when the crankshaft 6 is rotated by the connecting rod 7. For this, one end of the connecting rod 7 is connected to the eccentric pin 6*a* of the crankshaft 6, and the other end of the connecting rod 7 is coupled to the piston 15.

There is a valve assembly 20 mounted on an end of the cylinder 10 for controlling flow of a working fluid introduced into the compression chamber 11, compressed therein, and discharged therefrom, which will be described with reference to FIG. 2.

Referring to FIG. 2, the valve assembly 20 is provided with a valve plate 21, a suction valve 22, and a discharge valve 23.

The valve plate 21 has a suction hole 24 for introduction of the working fluid into the compression chamber 11, and a discharge hole 25 for discharging the working fluid to an outside of the compression chamber 11.

The suction valve 22 is between the cylinder 10 and the valve plate 21, for automatic opening/closing of the suction hole 24 according to a pressure change of the compression chamber 11. As shown in FIG. 2, the discharge hole 25 is provided, not only to the valve plate 21, but also to the suction valve 22.

The discharge valve 23 is provided to one surface of the valve plate 21 opposite to a surface the suction valve 22 is fitted thereto, for automatic opening/closing of the discharge hole 25 according to a pressure change of the compression chamber 11. As shown in FIG. 2, the suction hole is provided, not only to the valve plate 21, but also to the discharge valve 23.

In the meantime, there is a head assembly 30 on the valve assembly 20, more specifically, the discharge valve 23. Though not shown, there is a gasket between the head assembly 30 and the valve assembly 20, for preventing leakage of the working fluid, and pressure drop of the compression chamber. The head assembly 30 guides flow of the working fluid controlled by the valve assembly 20.

In the meantime, referring to FIG. 1, there is a suction muffler 13 connected to the head assembly 30, for attenuating noise of flow of the working fluid introduced into the compression chamber 11 through a suction pipe 12. There is a discharge pipe 14 connected to the head assembly 30 for discharge of the working fluid to an outside of the compression chamber through the discharge hole 25. Though not shown, there is a discharge muffler between the discharge pipe 14 and the head assembly 30 for attenuating noise from the working fluid.

In operation, upon application of power to the motor 5, the rotor 5*b* and the crankshaft 6 rotates, and the rotation of the crankshaft 6 is converted into linear reciprocating movement. According to this, the refrigerant introduced into the compressor through the suction pipe 12 is compressed by the piston reciprocating in the cylinder 10, and discharged to an outside of compressor through the discharge pipe 14.

Meanwhile, while above process is carried out, the piston 15 makes linear reciprocating movement within the cylinder 10 at a fast speed. In this instance, an inside wall of the cylinder 10, and an outside surface of the piston cause friction on each other, which drops an efficiency of the compressor due to a friction loss taken place in this time.

In the meantime, when the piston 15 is at a top dead center, a dead volume is formed, which has a size a top clearance existing between a top end of the piston 15 and the valve plate 21 and an inside volume of the discharge hole 25 are added together.

The dead volume formed thus drops the efficiency of the compressor. Therefore, it is preferable to minimize the dead volume.

SUMMARY OF THE INVENTION

Accordingly, the present invention is directed to a compressor that substantially obviates one or more of the problems due to limitations and disadvantages of the related art.

An object of the present invention lies on reducing a friction loss occurred when a piston and a cylinder make relative movement, to enhance an efficiency of a compressor.

Another object of the present invention lies on minimizing a dead volume occurred when the piston is at a top dead center, to enhance a compression efficiency.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the compressor includes a cylinder having a compression chamber therein, a piston including a head for reciprocating the cylinder while making friction with an inside wall of the cylinder, to draw a working fluid into the compression chamber, compress, and discharge the working fluid, a skirt extended from a lower end of the head spaced a predetermined distance away from the inside wall of the cylinder, and guide surfaces each projected from an outside circumferential surface of the skirt for guiding reciprocating movement of the head while making friction with the inside wall of the cylinder, and a connecting rod connected between the crankshaft and the piston, for converting rotation of the crankshaft into a linear reciprocating movement of the piston.

The guide surfaces are provided along a length direction of the piston.

At least two the guide surfaces are provided along a circumferential direction of the skirt at regular intervals.

The guide surface is provided over a range grater than at least 40° along a circumferential direction of the skirt around the longitudinal axis of the piston.

The guide surface includes a continuous surface from an outside circumferential surface of the head.

The outside circumferential surface of the skirt is provided at the same distance from a longitudinal axis of the piston. The outside circumferential surface of the skirt has the same radius curvature from the longitudinal axis of the piston.

The outside circumferential surface of the skirt may have an elliptical curvature from the longitudinal axis of the piston. In this case, it is preferable that an outside surface of the skirt and an outside surface of the guide surface are connected with a continuous surface without a step.

In other aspect of the present invention, there is provided a compressor including a cylinder having a compression chamber therein, a piston having a projection provided to a head in contact with the compression chamber for inserting into a discharge hole provided for discharging a working fluid when the head is close to a top dead center, for reciprocating inside of the cylinder to draw the working fluid, and compress and discharge the working fluid, a connecting rod connected between the crankshaft and the piston, for converting rotation of the crankshaft into a linear reciprocating movement of the piston.

The discharge hole has rounded edges of opposite ends.

The discharge hole has an intermediate part between opposite ends, having the same area.

The projection has a height the same with a length of the discharge hole.

The projection is at a position spaced away from a longitudinal axis of the piston.

The projection is conical with a fore end thereof cut away therefrom. In this case, the projection has a ratio of a diameter 'D' of a bottom end to a diameter 'd' of a top end within a range of 1.2~1.4:1.0. The projection has the following relation between a top end diameter 'd' thereof to a height thereof.

$$0.3<h/d<0.5$$

In another aspect of the present invention, there is provided a compressor including a cylinder having a compression chamber therein, a piston including a head for reciprocating the cylinder while making friction with an inside wall of the cylinder, to draw a working fluid into the compression chamber, compress, and discharge the working fluid, a projection provided to a head in contact with the compression chamber for inserting into a discharge hole provided for discharging a working fluid when the head is close to a top dead center, a skirt extended from a lower end of the head spaced a predetermined distance away from the inside wall of the cylinder, and guide surfaces each projected from an outside circumferential surface of the skirt for guiding reciprocating movement of the head while making friction with the inside wall of the cylinder, and a connecting rod connected between the crankshaft and the piston, for converting rotation of the crankshaft into a linear reciprocating movement of the piston.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
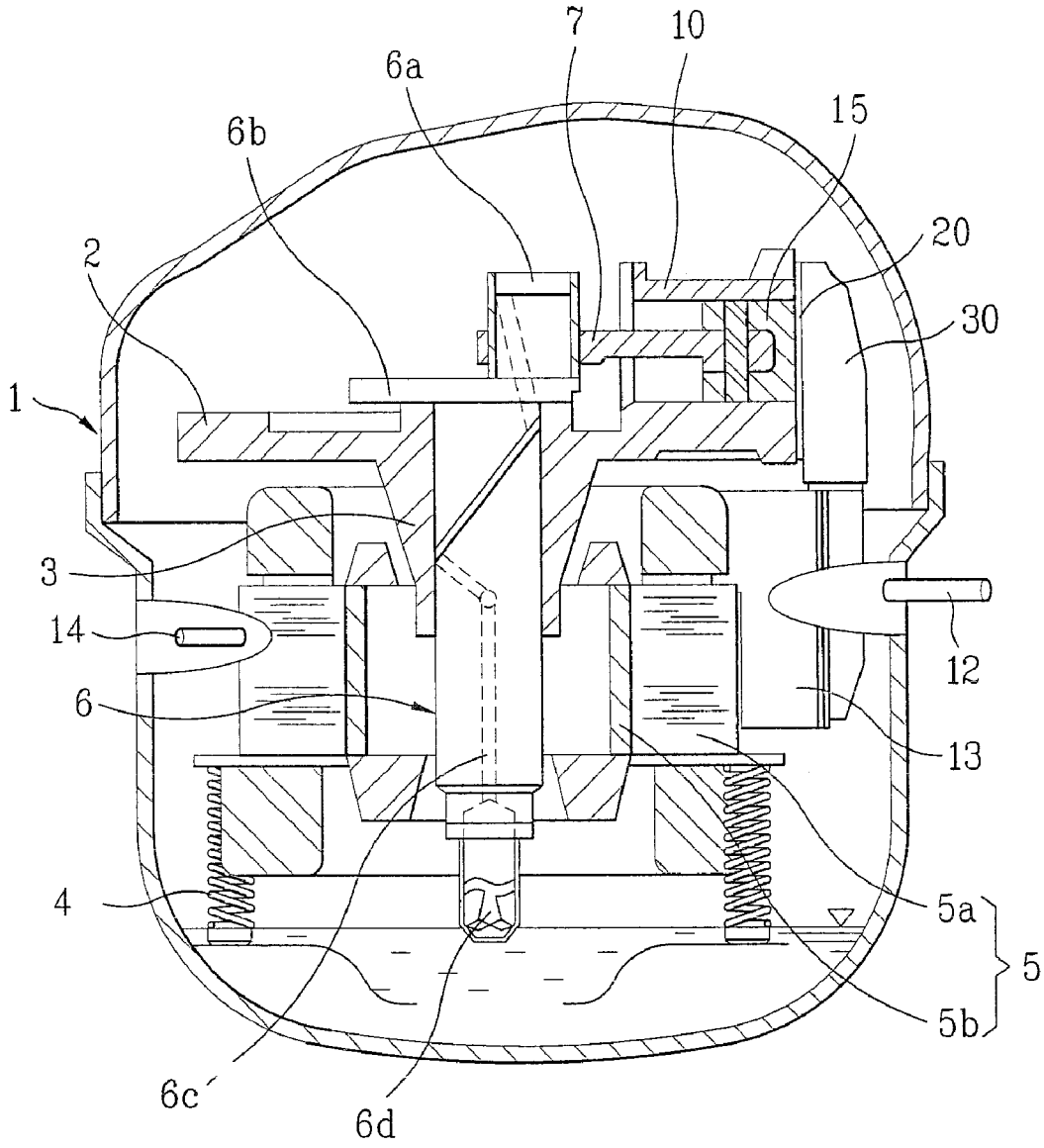
FIG. 1 Prior Art
FIG. 1 illustrates a section of a related art compressor.
Figure 2:
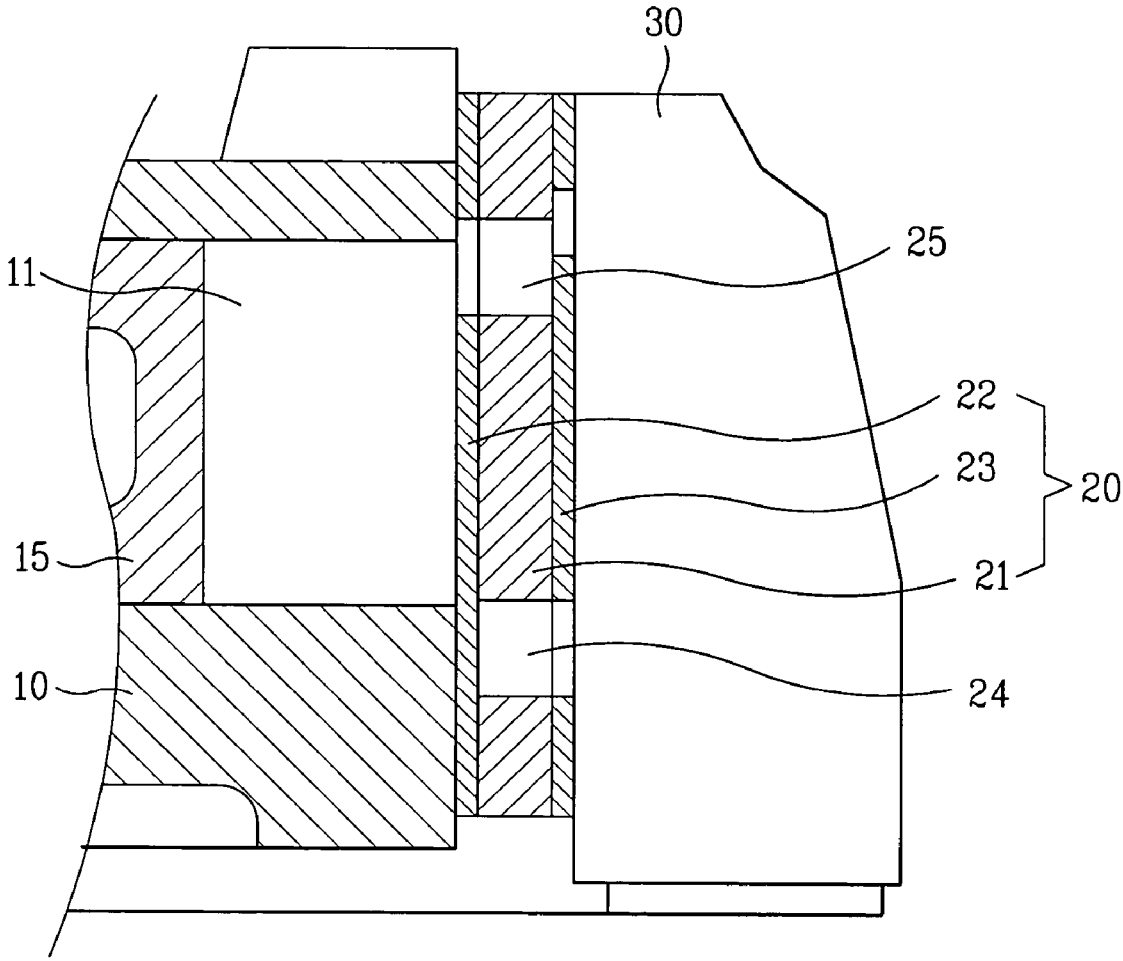
FIG. 2 Prior Art
FIG. 2 illustrates a section showing an enlarged view of the compressor in FIG. 1.
Figure 3:
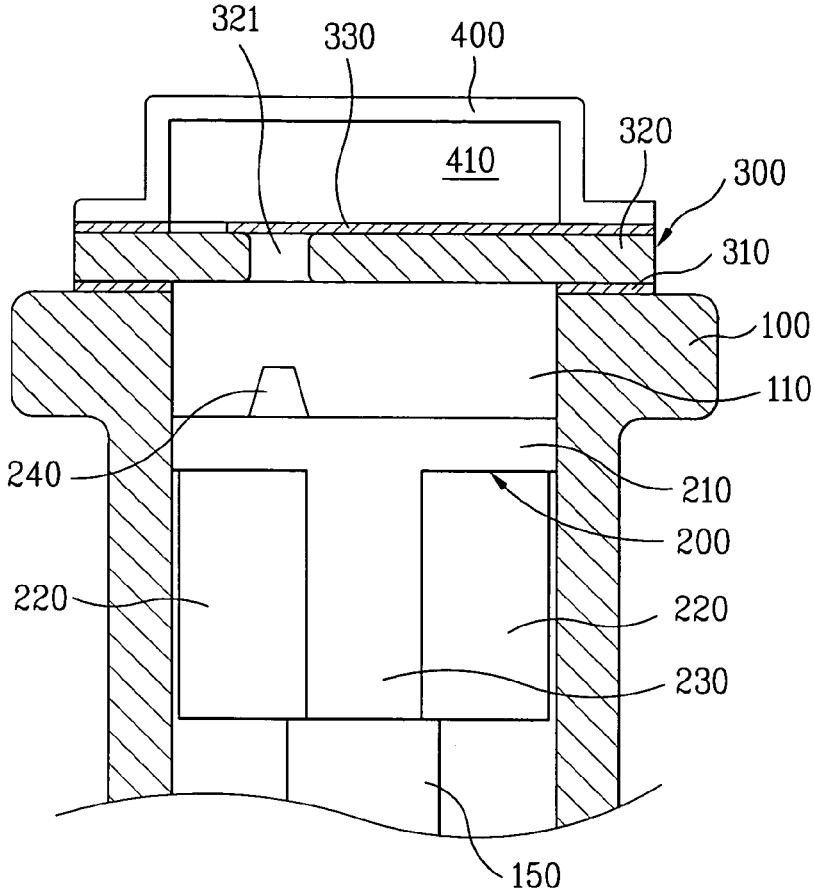
FIG. 3 illustrates a section showing a piston, a cylinder, a valve assembly, and a head assembly of the compressor of the present invention.
Figure 4:
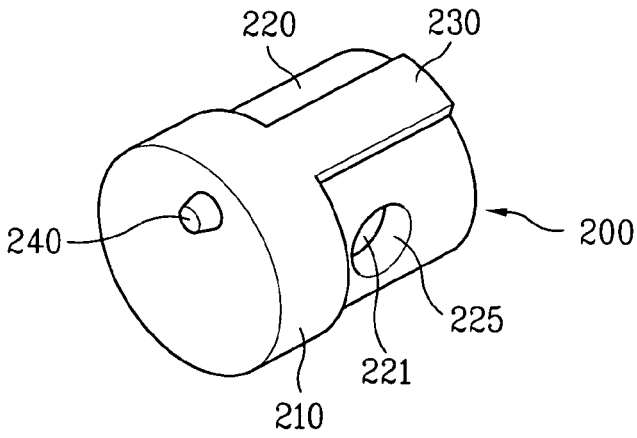
FIG. 4 illustrates a perspective view of the piston in FIG. 3.

Referring to FIG. 3, there is a cylinder having opened opposite ends, with a piston 200 of the present invention inserted therein. The piston 200 is coupled to one end of a connecting rod 150 inserted in the cylinder 100 through one of the opened ends of the cylinder 100, for an example, a lower end. For this, as shown in FIG. 4, the cylinder 100 has a pin hole 225, so that the piston (not shown) is passed through the pin hole 225 and the one end of the connecting rod 150 at the same time. Meanwhile, the other end of the connecting rod 150 is connected to the crankshaft (not shown) rotated by the motor (not shown).

The connecting rod 150, connecting the crankshaft and the piston thus, converts the rotating movement of the crankshaft to a linear reciprocating movement of the piston 200.

In the meantime, there is a valve assembly 320 of the present invention mounted on the other end, for an example, a top end, of the cylinder 100 having the piston 200 inserted therein. The valve assembly 320, enclosing the compression chamber 110, together with the piston 200 and the inside wall of the cylinder 100, controls a flow of the working fluid introduced into/discharged from the compression chamber 110.

Referring to FIG. 3, the valve assembly 320 includes a valve plate 320, a suction valve 310, and a discharge valve 330, which will be described in more detail.

The valve plate 320 includes a suction hole (not shown) for introduction of the working fluid into the compression chamber 110, and a discharge hole 321 for discharging the working fluid compressed in the compression chamber 110 to an outside of the compression chamber 110. For reference, the suction hole in the valve plate 320, and a part of a suction valve 310 for opening/closing the suction hole are not shown in FIG. 3.

Referring to FIG. 3, edges of opposite ends of the discharge hole 321, i.e., an inlet in contact with the compression chamber 110, and an outlet opposite to the inlet are rounded. This structure enables smoother guide of a flow of the working fluid discharged through the discharge hole 321.

It is preferable that opposite ends of the discharge hole 321, i.e., an intermediate part between the inlet and the outlet has the same sectional area. That is, the intermediate part between the inlet and the outlet is formed on a straight line. Then, the working fluid can flow more smoothly.

In the meantime, there is a suction valve 310 between the opened top end of the cylinder 100, and the lower end of the valve plate 320. There is a discharge valve 330 on the valve plate 320 opposite to the suction valve 310.

The suction valve 310 and the discharge valve 330, operative by a pressure of the compression chamber 110, automatically opens/closes the suction hole (not shown) and the discharge hole 321 respectively.

For an example, if the piston 200 moves down inside of the cylinder 100, a pressure of the compression chamber 110 drops lower than a predetermined level, when the suction valve 310 opens the suction hole, automatically.

Opposite to this, if the piston 200 moves up inside of the cylinder 100, a pressure of the compression chamber 110 rises higher than a predetermined level, when the discharge valve 330 opens the discharge hole 321, automatically.

There is a head assembly 400 over the valve plate 320. There is a discharge chamber 410 between the head assembly 400 and the valve plate 320. The working fluid, after introduced from the compression chamber 110 into the discharge chamber 410, is discharged to an outside of the compressor through the discharge muffler (not shown) and the discharge pipe (not shown).

In the meantime, when the motor is operated to rotate the crankshaft, the piston 200 reciprocates within the cylinder 100. Therefore, when the compressor is operated, an outside wall of the piston 200 and an inside wall of the cylinder 100 keep making relative movement in a state the outside wall of the piston 200 and the inside wall of the cylinder 100 are in contact with each other. Therefore, it is required to reduce a friction force taken place between the outside wall of the piston 200 and the inside wall of the cylinder 100 for enhancing an efficiency of the compressor.

For this, different from the related art, the present invention suggests a structure in which it is designed that, not all, but a part, of an outside circumferential surface of the piston 200 makes friction with the inside wall of the cylinder 100, which will be described in more detail.

Referring to FIGS. 3 and 4, the cylinder 100 includes a head 210, a skirt 220, and a guide surface 230.

The head 210 is an upper of the piston 200, has a top surface in direct contact with the compression chamber 110 in the cylinder 100. The head 210 is, for an example, a circular column, or a circular disk, inserted in the cylinder 100 such that the outside circumferential surface is in contact with the cylinder 100.

When the compressor is in operation, the head 210 provided thus reciprocates in the cylinder 100 while the head 210 makes friction with the inside wall of the cylinder 100. The reciprocating movement of the head 210 causes the refrigerant to be drawn into the compression chamber 110, compressed, and discharged to an outside of the compression chamber 110.

In the meantime, if a pressure leaks from the compression chamber 110 through a gap between the head 210 and the inside wall of the cylinder 100, the efficiency of the compressor drops. For preventing this, at least one piston ring (not shown) may be fitted to the outside circumferential surface of the head 210.

The skirt extends from a lower end of the head 210. For reference, in a typical piston, since the skirt is designed to have an outside diameter the same with the head, entire outside circumferential surface is in contact with the inside circumferential surface of the cylinder. However, as shown in FIGS. 3 and 4, the skirt 220 has an outside diameter smaller than an outside diameter of the head 210.

This structure enables the outside circumferential surface of the skirt 220 spaced a predetermined distance from the inside wall of the cylinder 100, such that the skirt 220 is not in contact with the inside wall of the cylinder 100. This structure enables to minimize the friction force generated when the piston 200 reciprocates.

In the meantime, in a case of above structure, if a length of the head 210 is not adequate, stable reciprocating movement of the piston 200 is hardly expected. However, the longer the length of the head 210, the friction force between the head 210 and the cylinder 100 can not but become greater.

Therefore, for solving such a problem, the guide surface 230 is provided. The guide surface 230 is projected from an outside circumferential surface of the skirt 220 to make friction with the inside wall of the cylinder 100, for stable reciprocating movement of the head 210.

Above structure enables the head 210 can be shorter, to have a lighter weight, to provide the same or a greater output than the related art for an input smaller than the related art.

For reference, since the skirt 220 having the guide surface projected therefrom has a hollow inside, the skirt 220 is lighter than the head 210.

In the meantime, the piston makes linear reciprocating movement along a length direction. Therefore, it is preferable that the guide surface 230 is formed along the length direction of the piston 200.

Referring to FIGS. 3 and 4, it is preferable that the guide surface 230 is continuous from the outside circumferential surface of the head 210. In this case, the outside diameter of the head 210 and the outside diameter of the guide surface 230 are the same with reference to a longitudinal axis of the piston 200. However, a structure of the guide surface 230 is not limited to this structure, but when required in piston design, the guide surface 230 may be designed to be discontinuous from the outside circumferential surface of the head 210.

Figure 5:
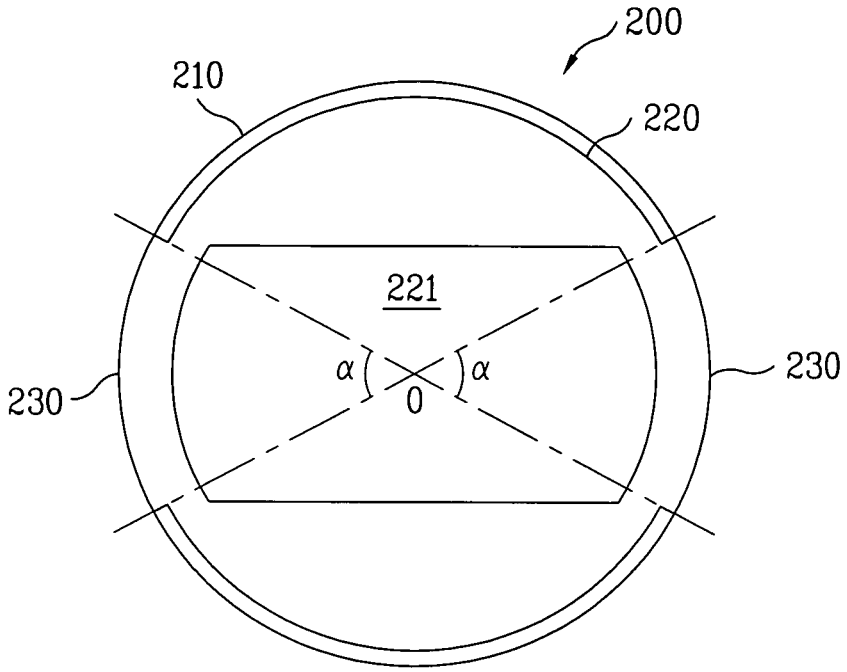
FIG. 5 illustrates a bottom view of the piston in FIG. 3.

At least two guide surfaces 230 are provided at regular intervals along a circumferential direction of the skirt 220. For reference, FIGS. 3 to 5 illustrate cases each showing an example in which two guide surfaces 230 are arranged opposite to each other with respect to the longitudinal axis of the piston. Above structure enables uniform distribution of a great force applied thereto in a compression stroke, and stable reciprocating movement of the piston 200.

In the meantime, for stable guidance of the reciprocating movement of the piston, it is preferable that the guide surface 230 has a width greater than a predetermined width. Therefore, referring to FIG. 5, in the present invention, an example is suggested in which the guide surface 230 is formed in a range at least greater than 40° around the longitudinal axis of the piston 200 along a circumferential direction (an angle '$\alpha$' in FIG. 5). For reference, the reference symbol 221 denotes is a piston chamber provided as the hollow inside of the skirt 220.

Referring to FIG. 5, in the piston 200 of the present invention having above structure, the outside circumferential surface of the skirt 220 may be provided at the same distance from the longitudinal axis of the piston 200. That is, the skirt 220 is formed such that the outside circumferential surface has the same radius of curvature with respect to the longitudinal axis of the piston 200.

This structure forms a step between the outside circumferential surface of the skirt 220 and the outside circumferential surface of the guide surface 230. Therefore, the case of embodiment illustrated in FIGS. 4 and 5 has a structure similar to one having a large recess formed in a skirt part of a cylinder with the same outside diameter.

Figure 6:
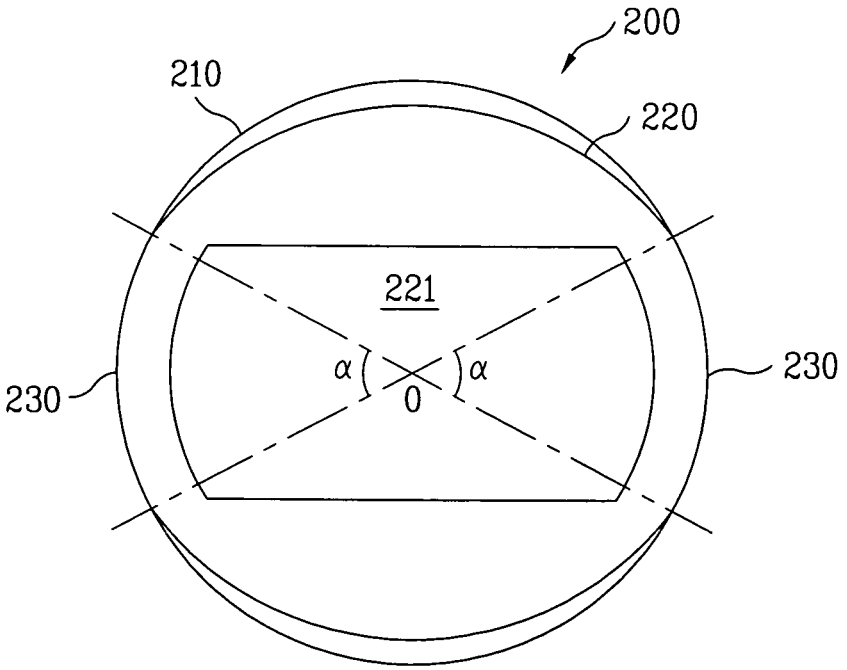
FIG. 6 illustrates a partial section showing a projection from the piston and a discharge hole in the valve assembly when the piston is at a top dead center in the compressor in FIG. 3.

In the meantime, FIG. 6 illustrates an embodiment different from the embodiment illustrated in FIG. 5. Referring to FIG. 6, the outside circumferential surface of the skirt 220 has an elliptical radius of curvature around a longitudinal axis of the piston 200. For reference, FIG. 6 illustrates an example in which the outside surface of the skirt 220 and the outside surface of the guide surface are continuous without step.

This structure forms the skirt 220 such that, while a part of the outside circumferential surface of the skirt 220 close to the guide surface 230 is close to the inside wall of the cylinder 100, a part of the outside circumferential surface of the skirt 220 that is to come into contact with the inside wall of the cylinder 100 during movement of the piston 200, i.e. a part far from the guide surface 230, is far from the inside wall of the cylinder 100.

Then, the contact between the outside circumferential surface of the skirt 220 of the piston 200 and the inside circumferential surface of the cylinder 100 can be prevented. And, reliability of the piston 200 can be enhanced without change in strength, and natural frequency of the piston 200.

In the meantime, though not shown, in a case the outside circumferential surface of the skirt 220 is elliptical, the skirt 220 may be formed to have a step between the guide surface 230 and the outside circumferential surface of the skirt 220.

In the meantime, if the dead volume formed when the piston 200 is at the top dead center is reduced, since a compression ratio can be increased without change of a diameter of the cylinder 100, of a stroke of the piston, to discharge more compressed working fluid, an efficiency of the compressor can be improved.

As described before, the dead volume has a volume of the top clearance, and a volume formed inside of the discharge hole 321 added together. For reference, a volume formed inside of the suction hole is not added to dead volume because the suction valve 310 closes the suction hole.

As a method for reducing the dead volume existing thus, the top clearance and/or the volume formed inside of the discharge hole 321 may be reduced.

However, when the top clearance is made to small, it is liable that the head 210 hits the valve assembly 320 to damage the compressor. In a case a diameter of the discharge hole 321 is reduced for reducing the volume of the discharge hole 321, a compressor capacity and a discharge pressure will be affected.

Therefore, referring to FIG. 3, for reducing the dead volume without causing above problem, the present invention suggests a structure in which the head 210 has a projection 240 further provided thereto. The projection 240 is provided to a top surface of the head 210 such that the projection 240 is inserted into the discharge hole 321 when the head 210 comes close to the top dead center, which will be described in more detail.

Referring to FIGS. 3 and 4, the projection 240 is provided at a position spaced a distance away from the longitudinal axis of the piston 200 so as to be inserted in the discharge hole 321.

It is preferable that the projection 240 has a height the same with a length from an inlet to an outlet of the discharge hole 321. This structure, not only enables to minimize a dead volume formed when the piston 200 is at the top dead center, but also prevents a top surface of the projecting 240 from hitting, and giving damage to, the discharge valve 330.

In the meantime, the projection has a shape of a cone with a fore end cut flat, wherein it is preferable that a ratio of a top diameter 'd' to a bottom diameter 'D' is within a range of 1.2~1.4:1.0.

The structure forms an area the working fluid can escape through the discharge hole 321 to become the greater as it goes from an inlet to an outlet of the discharge hole 321 when the piston 200 is at the top dead center. According to this, the working fluid compressed in the compression chamber 110 can be discharged through the discharge hole 321 more smoothly, and pulsation and noise of the working fluid can be reduced.

It is preferable that the projection 240 has a height 'h' greater than 0.3 times, and smaller than 0.5 times of the top diameter 'd'. That is, the top diameter 'd' and the height 'h' of the projection 240 have a relation of $0.3<h/d<0.5$.

Figure 7:
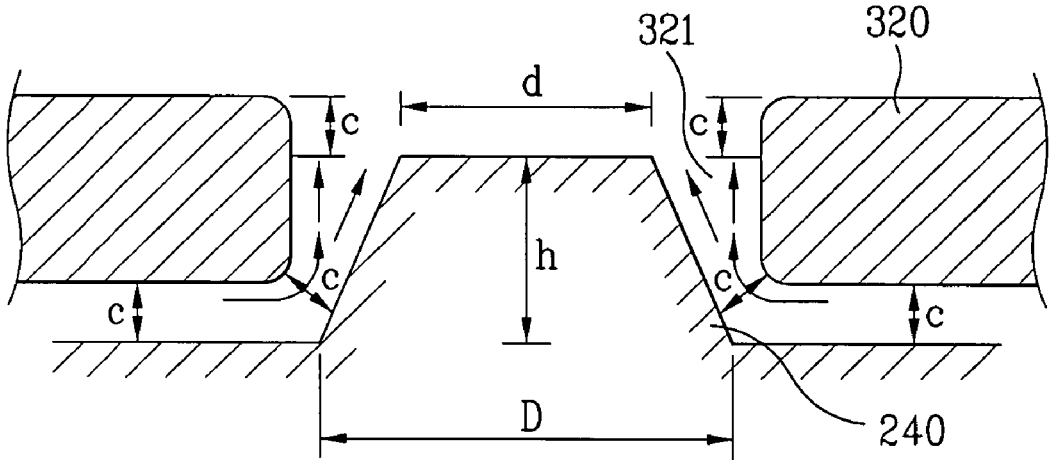
FIG. 7 illustrates a bottom view showing a variation of the piston in FIG. 3.

Referring to FIG. 7, the projection 240 provided to the top surface of the head 210 is inserted into the discharge hole 321 when the piston 200 is at the top dead center.

In this instance, if the top clearance between the top surface of the head 210 and a lower surface of the valve plate 320 is represented with 'c', a distance between the top surface of the projection 240 to the outlet of the discharge hole 321 is also 'c'. This is because the length of the projection 321 is the same with a height 'h' of the projection 240.

Moreover, it is preferable that a shortest distance between a lower side surface of the projection 240 and the rounded inlet of the discharge hole 321 is also the same with the top clearance. This structure enables smooth discharge of the working fluid because there is no part of a flow passage though which the working fluid is discharged through the discharge hole 321, having a diameter smaller than "c".

The operation of the compressor of the present invention will be described.

When the motor is put into operation, the crankshaft rotates, to reciprocate the piston 200 in the cylinder 100 through the connecting rod 150. During this process, the head 210 and the guide surface 230 come into contact with the inside wall of the cylinder 100, and guide the reciprocating movement of the piston 200, smoothly.

During the reciprocating movement of the piston 200, the outside circumferential surface of the skirt 220 makes no contact with the inside wall of the cylinder 100. Therefore, there is no power loss caused by friction between the piston 200 and the cylinder 100, and an efficiency of the compressor is improved.

In the meantime, during reciprocation of the piston 200, if the piston 200 moves down to a lower part of the cylinder 100, a pressure of the compression chamber 110 drops. According to this, the suction valve 310 opens the suction hole, to introduce the working fluid into the compression chamber 110.

When the crankshaft keeps rotating, to start to move the piston 200 upward, the pressure of the compression chamber 110 boosts. Then, the suction valve 310 closes the suction hole, to start compression of the working fluid in the compression chamber 110. When the pressure of the compression chamber 110 becomes high, the discharge valve 330 opens the discharge hole 321. Starting from this time, the working fluid is discharged to an outside of the compression chamber 321 through the discharge hole 321.

As shown in FIG. 7, when the piston 200 reaches to the top dead center as the compression is kept progressed, the projection 240 is inserted into the discharge hole 321. According to this, the dead volume is minimized. Meanwhile, since a discharge flow passage of the working fluid becomes larger gradually in a state the projection 240 is inserted in the discharge hole 321, the working fluid is discharged, smoothly. Moreover, the pulsation and noise of the working fluid is also reduced.

Thus, the working fluid is discharged to the outside of the compression chamber until the piston 200 reaches to the top dead center. The discharged working fluid is discharged to an outside of the compressor through the discharge muffler (not shown) and the discharge pipe (not shown).

In the meantime, the piston 200 moves down after the piston reaches to the top dead center. Then, the discharge valve 330 is closed automatically, and the suction valve 310 is opened, to introduce the working fluid into the compression chamber 110. While repeating above process, the compressor compresses the working fluid introduced thereto from an outside of the compressor, and discharges.

As has been described, the compressor of the present invention has the following advantages.

First, the piston of the present invention has a structure in which a friction area with the inside wall of the cylinder is minimized, to minimize a friction loss taken place between the piston and the cylinder, to provide a large output with a small input power.

Second, the stable guide of the linear reciprocating movement of the piston by the guide surfaces secures reliability of the compressor.

Third, the projection provided to the piston head for inserting into the discharge hole when the piston is at the top dead center reduces a dead volume. Therefore, an efficiency of the compressor is improved.

Fourth, the projection has a shape of a cone with a fore end thereof cut away therefrom. Therefore, even if the projection is inserted into the discharge hole, the working fluid can be discharged, smoothly. Moreover, the pulsation and noise of the working fluid is reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A compressors, comprising:

a cylinder having a compression chamber therein;

a piston having a projection provided on a head thereof in contact with the compression chamber configured to be inserted into a discharge hole that discharges a working fluid when the head is close to a top dead center, and configured to reciprocate within the cylinder to draw the working fluid, compress, and discharge the working fluid, wherein the projection has a relationship of $0.3<(h/d)<0.5$ between a top end diameter (d) thereof and a height (h) thereof; and a connecting rod connected between a crankshaft and the piston, to convert rotation of the crankshaft into a linear reciprocating movement of the piston.

2. The compressor as claimed in claim 1, wherein the discharge hole has rounded edges of opposite ends.

3. The compressor as claimed in claim 1, wherein the discharge hole has an intermediate part between opposite ends, having the same area.

4. The compressor as claimed in claim 1, wherein the projection has a height the same with a length of the discharge hole.

5. The compressor as claimed in claim 1, wherein the projection is at a position spaced away from a longitudinal axis of the piston.

6. The compressor as claimed in claim 1, wherein the projection is conical with a fore end thereof cut away therefrom.

7. The compressor as claimed in claim 6, wherein the projection has a ratio of a diameter (D) of a bottom end to a diameter (d) of a top end within a range of 1.2~1.4:1.0.

8. A compressors, comprising:

a cylinder having a compression chamber therein; and a piston including:

a head configured to reciprocate within the cylinder while making friction with an inside wall of the cylinder, to draw a working fluid into the compression chamber, compress, and discharge the working fluid;

a projection provided on the head in contact with the compression chamber configured to be inserted into a discharge hole that discharges a working fluid when the head is close to a top dead center, wherein the projection has a relationship of $0.3<(h/d)<0.5$ between a top end diameter (d) thereof and a height (h) thereof;

a skirt extended from a lower end of the head spaced a predetermined distance away from the inside wall of the cylinder;

a plurality of guide surfaces each projected from an outside circumferential surface of the skirt configured to guide reciprocating movement of the head while making friction with the inside wall of the cylinder; and a connecting rod connected between a crankshaft and the piston, that converts rotation of the crankshaft into a linear reciprocating movement of the piston.

9. The compressor as claimed in claim 8, wherein the plurality of guide surfaces is provided along a length direction of the piston, and along a circumferential direction of the skirt at regular intervals.

10. The compressor as claimed in claim 8, wherein the plurality of guide surfaces is provided over a range greater than at least 40° along a circumferential direction of the skirt around the longitudinal axis of the piston.

11. The compressor as claimed in claim 8, wherein the outside circumferential surface of the skirt has the same radius of curvature from the longitudinal axis of the piston.

12. The compressor as claimed in claim 8, wherein the outside circumferential surface of the skirt has an elliptical curvature from the longitudinal axis of the piston.

13. The compressor as claimed in claim 8, wherein the projection has a height the same as a length of the discharge hole.

14. The compressor as claimed in claim 8, wherein the projection is conical with a fore end thereof cut away therefrom.

15. The compressor as claimed in claim 14, wherein the projection has a ratio of a diameter (D) of a bottom end to a diameter (d) of a top end within a range of 1.2~1.4:1.0.

16. The compressor as claimed in claim 8, wherein each of the plurality of guide surfaces includes a continuous surface from an outside circumferential surface of the head.

17. The compressor as claimed in claim 8, wherein the outside circumferential surface of the skirt is provided at the same distance from a longitudinal axis of the piston.

18. The compressor as claimed in claim 8, wherein the outside circumferential surface of the skirt has the same radius of curvature from the longitudinal axis of the piston.

19. The compressor as claimed in claim 8, wherein the outside circumferential surface of the skirt has an elliptical curvature from the longitudinal axis of the piston.

20. The compressor as claimed in claim 19, wherein an outside surface of the skirt and an outside surface of the guide surface are connected with a continuous surface without a step.

* * * * *